US010798998B2

(12) United States Patent
Ritchie

(10) Patent No.: US 10,798,998 B2
(45) Date of Patent: Oct. 13, 2020

(54) ZIP FASTENER

(71) Applicant: MRM HK Limited, Hong Kong (CN)

(72) Inventor: Luke James Ritchie, Yuen Long (HK)

(73) Assignee: MRM HK Limited, Hong Kong (CN)

( * ) Notice: Subject to any disclaimer, the term of this patent is extended or adjusted under 35 U.S.C. 154(b) by 0 days.

(21) Appl. No.: 16/618,506

(22) PCT Filed: Jun. 1, 2018

(86) PCT No.: PCT/CN2018/089607
§ 371 (c)(1),
(2) Date: Dec. 2, 2019

(87) PCT Pub. No.: WO2018/219349
PCT Pub. Date: Dec. 6, 2018

(65) Prior Publication Data

US 2020/0121035 A1 Apr. 23, 2020

(30) Foreign Application Priority Data

Jun. 2, 2017 (AU) ..... 2017902120

(51) Int. Cl.
*A44B 19/30* (2006.01)

(52) U.S. Cl.
CPC ..... *A44B 19/301* (2013.01)

(58) Field of Classification Search
CPC ..... A44B 19/301; A44B 19/36; A44B 19/26; A44B 19/305
See application file for complete search history.

(56) References Cited

U.S. PATENT DOCUMENTS 3,959,858 A * 6/1976 Fukuroi ..... A44B 19/36 24/435
4,395,891 A * 8/1983 Remington ..... A44B 19/301 70/68
4,512,599 A * 4/1985 De Lima Castro Netto ..... A44B 19/301 24/388
4,514,884 A * 5/1985 Kaneko ..... A44B 19/301 190/120
4,995,656 A * 2/1991 Akashi ..... A44B 19/301 292/307 R (Continued)

OTHER PUBLICATIONS

International Search Report in PCT/CN2018/089607, dated Aug. 15, 2018.

*Primary Examiner* — Jason W San
(74) *Attorney, Agent, or Firm* — Leydig Voit & Mayer Ltd.; John Augustyn

(57) ABSTRACT

A zip fastener may include a first slider disposed to slide lengthwise along a pair of stringers, and which includes one of a male part and a complementary female part. The other of the male part and the female part is formed on either a member, which may be a fixture fixed to the stringers, or a second slider. The male coupling part includes a neck adjacent an enlarged head, and the female coupling part includes a transverse slot with broad and narrow sections. In a two-handed operation, the male and female parts are mutually engaged to connect the first slider and the member by relative transverse movement, to pass the male part through a mouth of the transverse slot. When latched is closed in this way, axial separation of the first slider from the member is precluded.

12 Claims, 5 Drawing Sheets

(56) References Cited

U.S. PATENT DOCUMENTS 5,013,162 A * 5/1991 Williams ..... A44B 19/301 190/120
5,031,944 A * 7/1991 Keyaki ..... A44B 19/301 292/307 R
5,065,602 A * 11/1991 Williams ..... A44B 19/301 190/903
6,510,593 B1 * 1/2003 Kim ..... A44B 19/301 24/382
7,073,233 B2 * 7/2006 Leva ..... A44B 19/26 24/386
D526,931 S * 8/2006 Koenig ..... D11/221
7,533,451 B2 * 5/2009 Akashi ..... A44B 19/301 24/386
7,979,964 B2 * 7/2011 Jans ..... A44B 19/301 24/386
8,650,724 B2 * 2/2014 King ..... A45C 13/103 190/120
9,375,059 B2 * 6/2016 Jin ..... A44B 19/303
9,456,663 B1 * 10/2016 Wheeler ..... A44B 19/301
9,629,423 B2 * 4/2017 Schlipper ..... A44B 19/262
9,776,770 B2 * 10/2017 Petkovsek ..... B65D 33/2591
9,888,747 B2 * 2/2018 Smith ..... A44B 19/36
9,902,529 B2 * 2/2018 Reinders ..... B65D 33/2591
10,492,572 B1 * 12/2019 Omote ..... A44B 19/26
10,512,314 B2 * 12/2019 Holliday, Jr. ..... A44B 19/12
2002/0070566 A1 * 6/2002 Hudson ..... A44B 19/301 292/315
2004/0083782 A1 * 5/2004 Lantz ..... E05B 39/02 70/423
2005/0109072 A1 * 5/2005 Ling ..... E05B 37/02 70/68
2006/0000066 A1 * 1/2006 Lin ..... A44B 19/26 24/415
2007/0067969 A1 * 3/2007 Kusayama ..... A44B 19/32 24/436
2007/0113384 A1 * 5/2007 Ortlieb ..... A44B 19/32 24/385
2008/0196217 A1 * 8/2008 Eschbach ..... A44B 19/262 24/386
2008/0295300 A1 * 12/2008 Jans ..... A45C 13/103 24/385
2009/0106951 A1 * 4/2009 Edwards ..... A44B 19/26 24/386
2012/0159746 A1 * 6/2012 Matsumoto ..... A44B 19/26 24/386
2013/0185841 A1 * 7/2013 Berkowitz ..... A41D 13/00 2/69
2014/0069757 A1 * 3/2014 Schlipper ..... A45C 13/103 190/113
2018/0008012 A1 * 1/2018 Lin ..... A44B 19/42
2018/0008013 A1 * 1/2018 Lin ..... A44B 19/64
2019/0090596 A1 * 3/2019 Huyke-Phillips ..... B65D 33/2591
2019/0142116 A1 * 5/2019 Cheng ..... A44B 19/26 24/389
2020/0015553 A1 * 1/2020 Wang ..... A44B 19/36

* cited by examiner

ZIP FASTENER

TECHNICAL FIELD

The present invention relates to zip fasteners with security features for latching the zip fastener closed.

BACKGROUND OF THE INVENTION

Zip fasteners are often used in applications where a degree of security is desirable. Locking the zip fastener closed can be achieved, for instance, by latching a slider to a fixture at one end of the zip or, where the zip includes two sliders, by latching the two sliders together.

While a lock, such as a padlock, can be used to lock the zip fastener closed, this may not be convenient or necessary in all circumstances, so it is advantageous to provide a zip with child-proofing, or a degree of security that is sufficient to defeat casual theft. In particular, this may include an arrangement that is difficult to open with a single hand. CN103653566A describes such a zip fastener with two sliders each having a like locking pull tab, and in which the pull tabs can be interlocked with one another by a slide-and-turn action that provides the security against casual theft. However, there are drawbacks to this system, related to the appearance of the locking pull tab and its exposed location. Its unconventional shape may undesirably suggest it provides some security function and, particularly for manufacturers making a large range of products, for aesthetic reasons it may not be desired to use the locking pull tabs on all products, so conventional pull tabs cannot be eliminated to reduce the part count in the zip assembly.

EP20027444A1 describes the use of complementary male and female couplers on the two sliders, used to lock the two sliders together. Drawing the sliders together in the axial direction to close the zip also engages the male and female couplers, and they are retained in this closed position by a resilient action. For instance, to remove the male from the female coupler, a resilient tongue is deflected. A drawback of this arrangement is that it provides little or no casual security as moving one slider longitudinally with respect to the other to break the connection (and open the zip) is familiar and intuitive.

It is an object of the present invention to overcome or substantially ameliorate the above disadvantages or, more generally, to provide an improved zip fastener.

DISCLOSURE OF THE INVENTION

According to one aspect of the present invention there is provided a zip fastener, comprising:

a pair of stringers defining a longitudinal axis;

a first slider disposed to slide lengthwise along the stringers and thereby join the stringers and close an opening between the stringers, the first slider including, at one axial end thereof, one of a male coupling part and a complementary female coupling part;

a member secured to at least one of the stringers, the member including, at one axial end thereof, the other of the male coupling part and complementary female coupling part;

the male coupling part comprising a neck adjacent an enlarged head, and the female coupling part comprising a transverse slot with broad and narrow sections sized to slidably receive the head and neck, such that relative rotation between the first slider and the member, and resulting bending of the stringers, allows the head to be inserted transversely into the slot, and the bending stiffness of the stringers tends to maintain the head in the slot, and a shoulder between the broad and narrow sections of the female coupling part abuts the head to prevent axial separation of the first slider and the member when the head is in the slot, and the member is either a) a second slider that is disposed to slide lengthwise along the stringers and thereby join the stringers and close the opening between the stringers, or b) a fixture on at least one of the stringers.

In a zip fastener of this type some relative movement (between the member and the first slider) in a transverse direction is possible to achieve manually at or near the closed position, due to a combination of the bending flexibility of the stringers and play between the stringers and the slider. In typical applications the zip fastener is used for security in soft bags, such purses, wallets, travel bags, sports bags, backpacks, where the material to which the stingers are fixed is also flexible. However, the required transverse movement is sufficiently small that it can also be used in bags with a hard shell, such as briefcases and suitcases.

Preferably a plane defined by long axes of the stringers separates inner and outer sides of the zip fastener, a first pull-tab attachment post is disposed on the outer side of the first slider, and the transverse slot has a mouth through which the head transversely passes when the male and female coupling parts are connected and disconnected, the mouth being disposed on the outer side of the respective one of the first slider and the member. Positioning the mouth thus makes it readily visible, helping make the requires action to engage the male and female parts simple and intuitive. Preferably the one of the male coupling part and complementary female coupling part is disposed on the outer side of the zip fastener and projects axially from the first pull-tab attachment post.

Preferably the zip fastener further comprises a detent that restricts transverse movement of the male part relative to the female part. Preferably the detent provides an audible indication of engagement between the male and female parts. An audible indication of engagement is beneficial as, owing to the small amount of relative movement between the sliders that connects one to the other, obtaining a visual confirmation of proper connection may be difficult.

Preferably the head projects from opposing sides of the neck and the detent comprises a clip of resilient material with a pair of opposing arms, tips of the arms disposed adjacent the female coupling part such that the transverse slot extends between the tips and the tips engage opposing sides of the male coupling part, with each tip and respective one of the opposing sides comprising one of a projection and complementary recess.

Preferably the head further comprises opposing ramps that, upon connection of the male and female parts, spread apart the ends of the arms to engage the opposing sides of the male coupling part.

Preferably the female part further comprises a stop surface extending into the broad section to abut the head and limit transverse travel of the head in the slot.

Preferably the first slider comprises wedge faces that divide a main channel that receives meshed stringers into two branch channels that receive unmeshed stringers and are disposed on either side of a central plane, wherein the wedge faces taper to diverge in the longitudinal direction from a narrow end adjacent the main channel to a broad end, wherein the female part comprises opposing flanges disposed on either side of the central plane.

Preferably the wedge faces comprise outer faces of the clip.

Preferably the clip is held in a recess in the first slider by a snap fit.

Preferably the first slider comprises wedge faces that divide a main channel that receives meshed stringers into two branch channels that receive unmeshed stringers and are disposed on either side of a central plane, wherein the wedge faces taper to diverge in the longitudinal direction from a narrow end adjacent the main channel to a broad end, wherein the male part comprises a rib that projects from the broad end of the first slider, wherein a proximal end of the rib forms the neck and a distal end of the rib is thickened to form the head.

Preferably the male part comprises a rib that projects from the broad end of the first slider, wherein a proximal end of the flange forms the neck and a distal end of the rib is thickened to form the head; wherein the main channel and branch channels of each slider are bounded by opposing inner and outer walls having edges tapered in the longitudinal direction, a fixture projects from each outer wall and is adapted to receive a pull tab, and on the first slider the rib is connected to the fixture.

Preferably the rib further comprises a circular hole adapted to receive a shackle.

Advantageously, the male and female coupling parts can be made small in the invention, requiring very little material, and requiring a small transverse movement for engagement and disengagement. Even if not mutually engaged to restrain movement to the open position, owing to its size and location the zip fastener is still closes to the extent that even small items could not pass through it, so even on items where casual security or child-proofing is not required it can be incorporated, allowing manufacturers to reduce part counts while still covering a wide range of applications.

BRIEF DESCRIPTION OF THE DRAWINGS

Preferred forms of the present invention will now be described by way of example with reference to the accompanying drawings, wherein:

FIG. 13 is a plan view of the fixture of FIG. 11, and.

DESCRIPTION OF THE PREFERRED EMBODIMENTS

Figure 1:
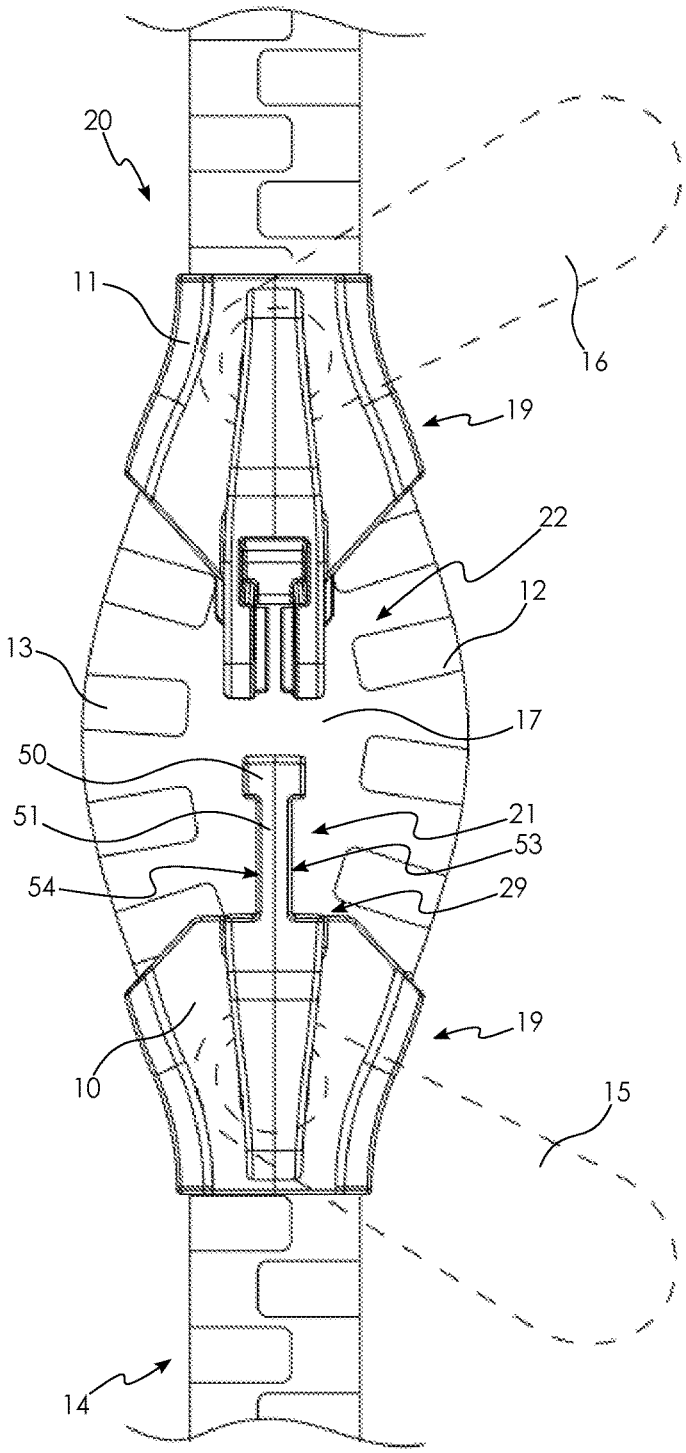
FIG. 1 is a view from the outside of a zip fastener according to a first embodiment of the invention, showing two sliders spaced apart.
Figure 2:
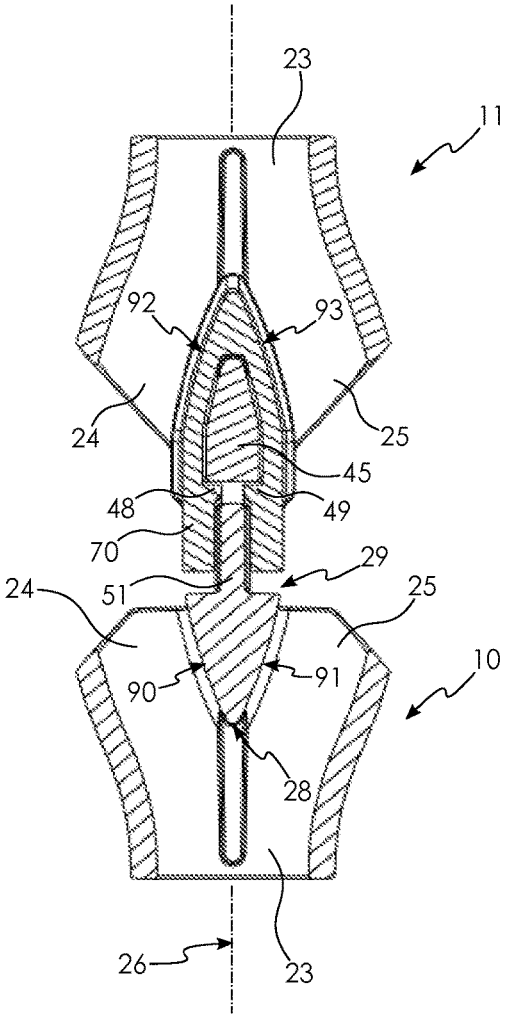
FIG. 2 is a section in a longitudinal transverse plane showing the sliders of FIG. 1 connected to one another.

Referring to FIGS. 1 and 2, a first embodiment of a zip fastener 20 generally comprises a first slider 10 and a second slider 11, both engaged with a pair of stringers 12, 13 (shown schematically) which may be connected together by means of meshed teeth 14, in the well-known manner Additionally, two pull tabs 15, 16 (shown in dashed outline) are provided, and they may be connected to an outer side of the respective slider 10, 11, to allow for improved purchase for the user to pull the sliders 10, 11 along the stringers 12, 13. Relative movement between the sliders 10, 11 along the stringers 12, 13 opens and closes the zip fastener 20 or, more specifically, opens and closes an opening 17 between the stringers 12, 13 and sliders 10, 11.

Front ends of the sliders 10, 11 are arranged opposing one another and have a male part 21 and female part 22 respectively. Rearward ends of the sliders 10, 11 each comprise a body 19 of like form that is tapered in the longitudinal direction and encloses a main channel 23 that bifurcates to form two branch channels 24, 25 on either side of a central plane 26 that is aligned longitudinally. Mutually inclined pairs of opposing wedge face 90, 91 and 92, 93 of each slider 10, 11 divide the main channel 23 that receives the meshed stringers into the two branch channels 24, 25 receiving unmeshed stringers 12, 13. On each slider 10, 11 the respective wedge faces if each pair 90, 91 and 92, 93 are inclined in the same direction as the body 19 tapers, diverging in the longitudinal direction from a rearward narrow end 28 adjacent the main channel 23 to a broad end 29. In the first slider 10 the wedge faces 90, 91 are formed on a web 45 which is wedge-shaped and may be integral with the body 19 and symmetrical on either side of the central plane 26.

Figure 3:
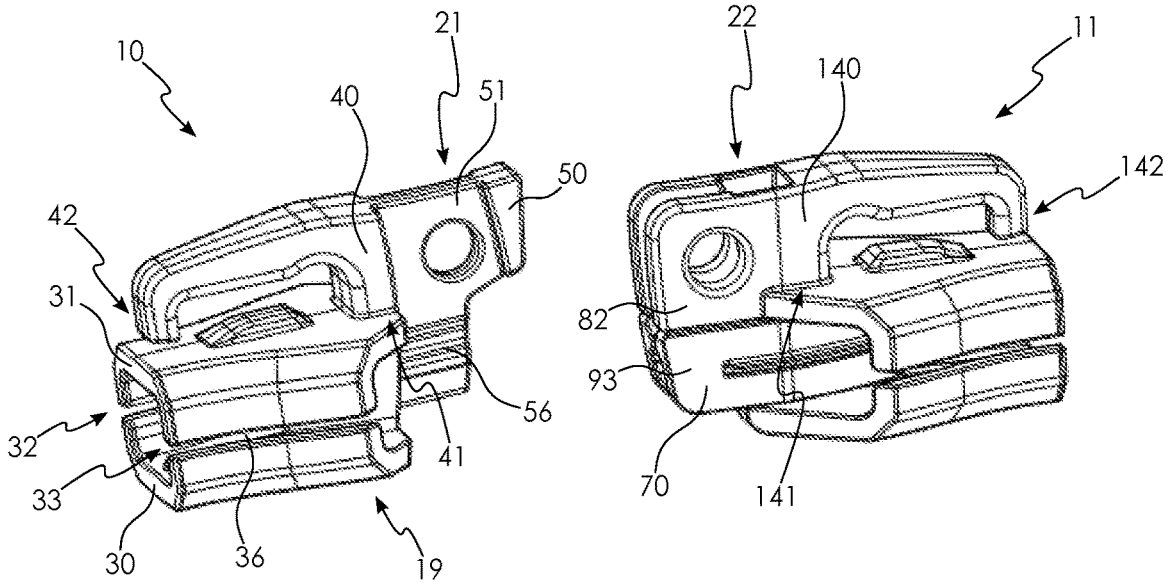
FIG. 3 is a perspective view of the sliders of FIG. 1.

As best seen in FIG. 3, the body 19 may further comprise opposing inner and outer walls 30, 31, the longitudinal edges of which may be curved to join to integral side walls 32, 33. Edges of the inner and outer walls 30, 31 may taper in the longitudinal direction. Each of the side walls 32, 33 bounds a part of the main channel 23 and a part of one of the two branch channels 24, 25, while the inner and outer walls 30, 31 bound both of the branch channels 24, 25 and the main channel 23 on their respective inner and outer sides. Each of the side walls 32, 33 may be divided into two parts by a longitudinal slot 36.

Figure 4:
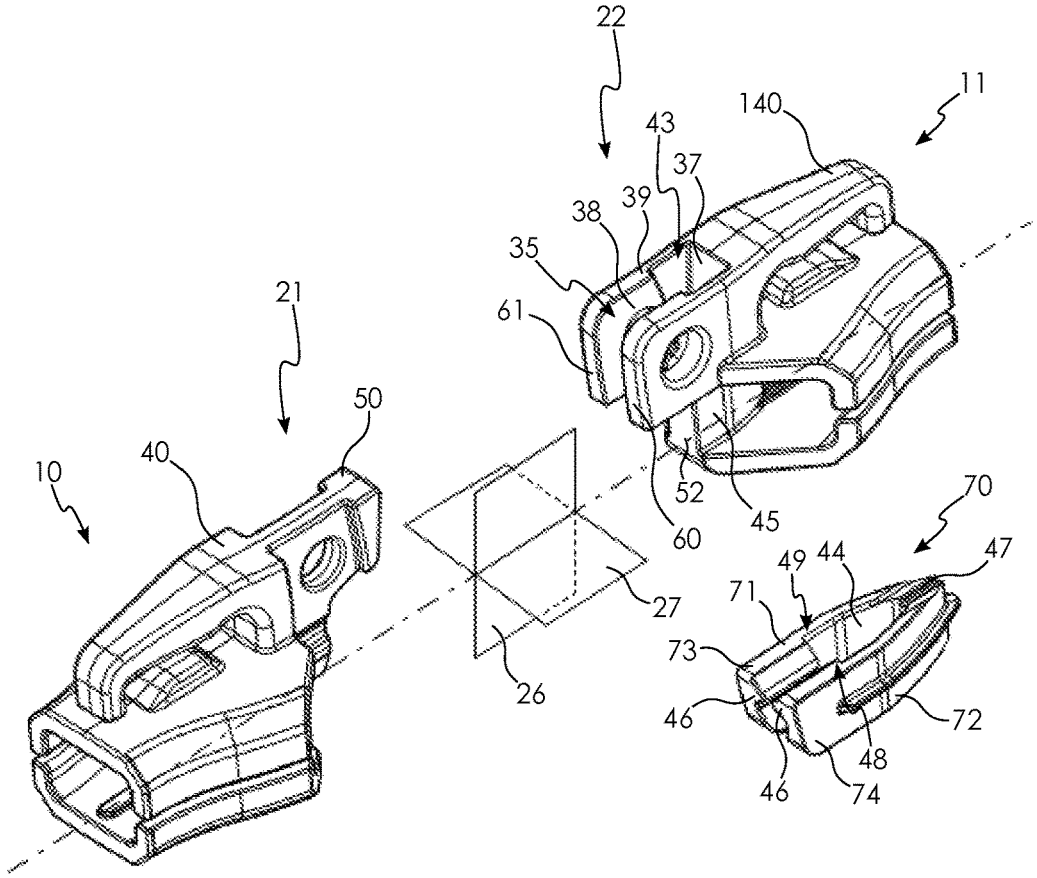
FIG. 4 is an exploded perspective view of the sliders of FIG. 1.

A pull-tab attachment post 40, 140, best seen in FIGS. 3 and 4, may project from the outer wall 31 of the sliders 10, 11 to receive an opening in one of the pull tabs 15, 16. The pull-tab attachment post 40, 140 may be connected to the body 19 only at a proximal end 41, 141, and may include a leg part extending outward, and a longitudinally extending part terminating at a free end 42, 142. The pull-tab attachment posts 40, 140 are on an outer side of the zip fastener 20, that is on the outer side of a longitudinal-transverse plane 27 defined by long axes of the stringers 13, 14 that is orthogonal to the central plane 26.

Referring to FIGS. 1 and 3, a male coupling part 21 may be generally in the form of a rib projecting longitudinally from the broad end 29 and generally bisected by the central plane 26. The male coupling part 21 may also project longitudinally from the leg part of the pull-tab attachment post 40. The rib may be integral with the broad end 29 and the pull-tab attachment post 40. A distal end of the male coupling part 21 may be thickened on both sides to form the head 50 of enlarged form, while opposing, generally planar sides 53, 54 of the male coupling part 45 itself form a neck 51 disposed adjacent the head 50. The male coupling part 21 is disposed on the outer side of the slider 10. A recess 56 in the sides 53, 54 may be formed in the rib in the inner side of the zip fastener 20.

Figure 7:
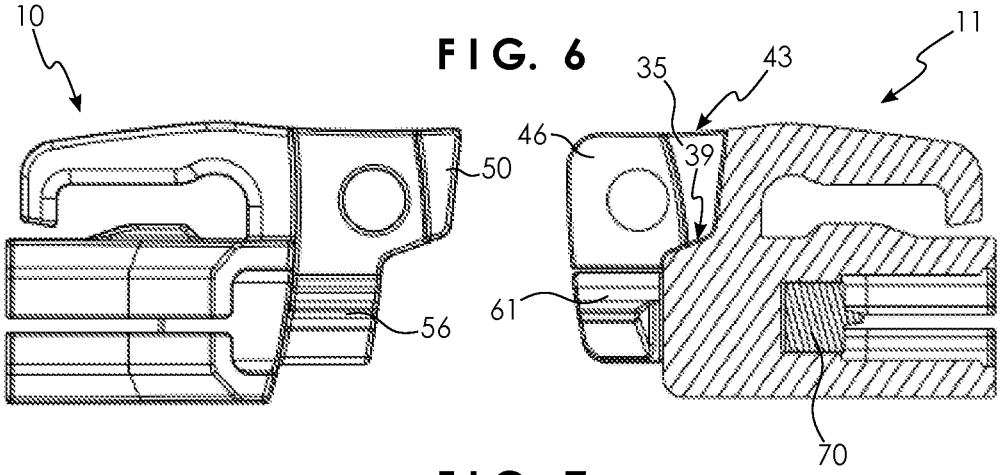
FIG. 7 is a part-sectional view along line AA in FIG. 6.

On the slider 11, as best seen in FIGS. 4 and 7, the female coupling part 22 may comprise opposing flanges 60, 61 that project from the broad end 29 on either side of the central plane 26. The female coupling part 22 may also project longitudinally from the leg part of the pull-tab attachment post 140. The flanges 60, 61 may be integral with the broad end 29 and the pull-tab attachment post 140 and define between them a transverse slot 35 with broad and narrow sections 37, 38 sized to slidably receive the head 50 and neck 51 respectively. A shoulder 39 is disposed between the narrow section 37 and the broad section 38 and abuts the head 50 to prevent axial separation of the sliders 10, 11 when the head 50 is in the transverse slot 35. An open mouth 43 of the transverse slot 35 is disposed on the outer side of the slider 11. Opposite the mouth 43 a stop surface 39 closes the inner end of the slot 35, and may abut the head 50 to limit its transverse travel.

The male coupling part 21 and the respective body 19 may be integral (forming the slider 10) and, likewise, the female coupling part 22 and its respective body 19 may be integral, and manufactured as by die casting.

Figure 5:
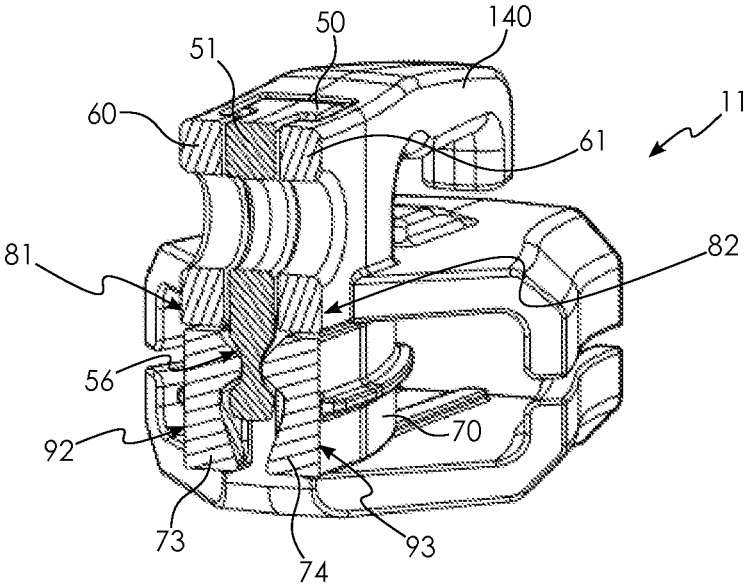
FIG. 5 is a section in an upright transverse plane showing the sliders of FIG. 1 connected to one another.
Figure 6:
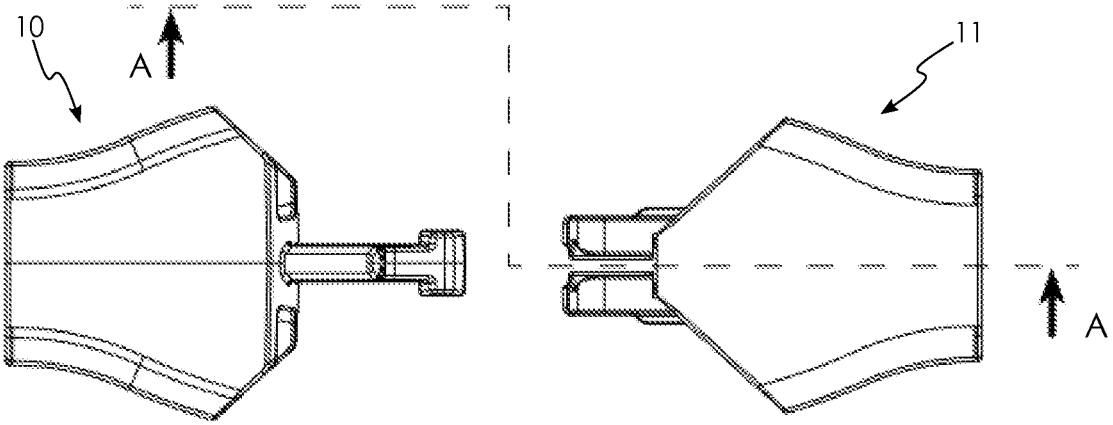
FIG. 6 is a view from the inside of the sliders of FIG. 1.

Referring to FIGS. 3 to 5, the zip fastener 20 further comprises a clip 70 mounted to the slider 11. The clip 70 is made of resilient material in a V-shape and comprises a pair of arms 71, 72 opposing one another on either side of the central plane 26, integral with one another at one end 47 and with respective opposite free ends 73, 74. Upon connection of the male and female parts 21, 22, projections 46 on the ends 73, 74 first abut the opposing sides 53, 54, before the projections 46 enter into the recesses 56, which action causes an audible snap indicative of proper engagement between the male and female parts 21, 22. At the ends 73, 74, outer faces 81, 82 of the flanges 60, 61 may be coplanar with ends of the wedge faces 92, 93 of the clip 70 to which they are adjacent. An opening 44 in clip 70 between the arms 71, 72 and between the one end 47 and the shoulders 48, 49 adjacent the projections 46 has a complementary shape to that of the web 45 that extends between the inner and outer plates 30, 31. The clip 70 is attached by inserting it into the body of the slider 11 with one of the arms 71, 72 either side of the web 45. The shoulders 48, 49 are resiliently urged apart when the clip 70 is inserted and snap back to engage face 52 of the web 45, forming a snap fit that permanently holds the clip 70 in place.

Figure 8:
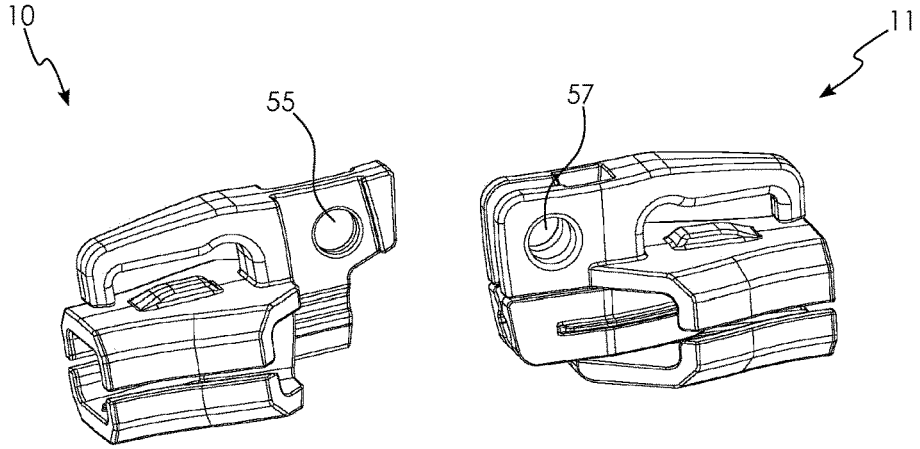
FIGS. 8, 9 and 10 are perspective views of the sliders of FIG. 1 at the spaced apart position, an intermediate position (showing part of one slider and the clip cut-away) and at the connected position to illustrate consecutive stages during their connection.
Figure 9:
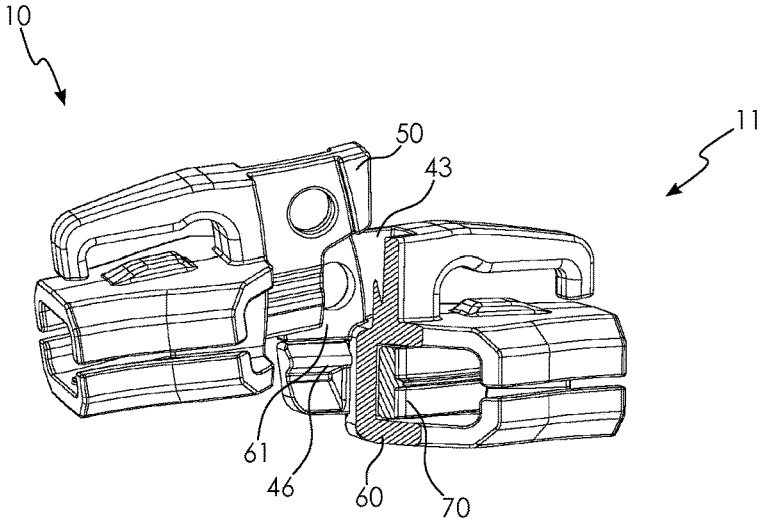
Figure 10:
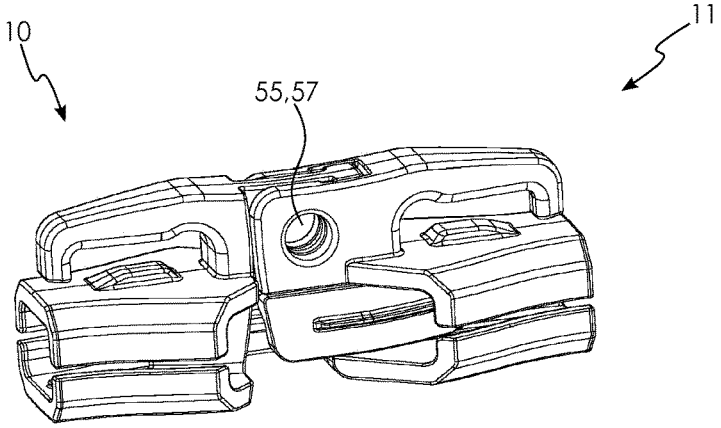

With reference to FIGS. 8 to 10, in use, as the sliders 10, 11 are drawn together they are rotated and/or displaced transversely relative to one another in a first transverse direction sufficient to displace the head 50 transversely from the mouth 43 of the transverse slot 35. This requires two hands, as with one hand grasping each of the pull-tabs 15, 16 (not shown in FIGS. 8-10 for clarity). For instance, slider 10 may remain stationary, while slider 11 is rotated to the intermediate position shown in FIG. 9, where part of the flange 60 is shown cut away, along with part of the clip 70. This movement is small, as shown, and requires bending of the stringers 12, 13 (not shown in FIGS. 8-10 for clarity) but is insufficient to cause any significant friction or binding that might tend to restrict free longitudinal sliding of the sliders 10, 11. Subsequently, relative rotation and/linear displacement in a second transverse direction opposite the first direction initially enters the head 50 transversely through the mouth 43. Of course this movement in the second transverse direction is aided by the stringers 12, 13 which want to return to their original state. Continued movement in the second transverse direction slides the head 50 toward the stop surface 67. As the head 50 approaches or contacts the stop surface 67 the projections 46 snap into the recesses 56 with an audible click. The tactile and audible feedback of detent actuation indicates that the sliders 10, 11 are properly connected. In this closed position, the head 50 is restrained by the shoulders 39 from being drawn longitudinally between the lips 63, while the detent action of the cooperating ends 73, 74 and recesses 56 restrains the head 50 from passing back out of the open end 68 to release the male and female parts 21, 22. Both the detent clip 70 and the bending stiffness of the stringers 13, 14 tend to maintain the head 50 in the slot 35.

On the first slider 10 the male coupling part 21 further comprises a hole 55 adapted to receive a shackle. Like holes 57 may be disposed in each of the flanges 60, 61 and aligned coaxially. The hole 55 is located in registration with the holes 57 in the closed position. In this manner, a padlock can be used when a higher degree of security is desired, its shackle (not shown) passing through the holes 55, 57 to connect the sliders 10, 11.

Figure 11:
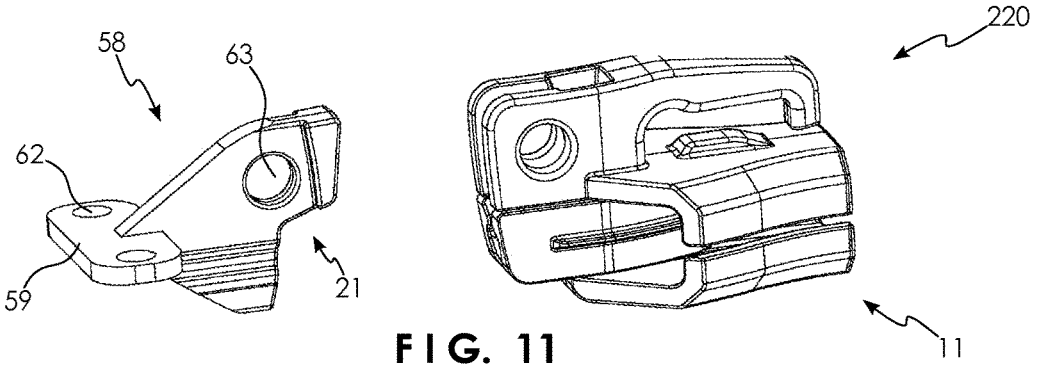
FIG. 11 is a perspective view of a zip fastener according to a second embodiment of the invention, showing a slider and a fixture spaced apart.
Figure 12:
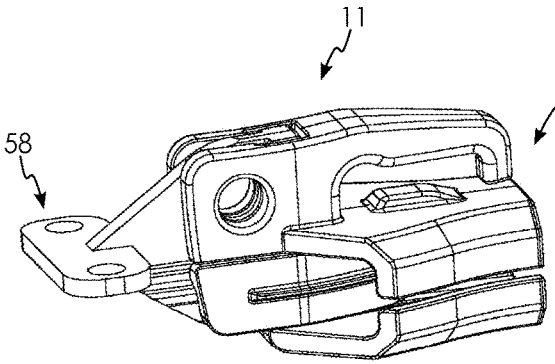
FIG. 12 is a perspective view of the slider and fixture of FIG. 11 mutually connected.
Figure 13:
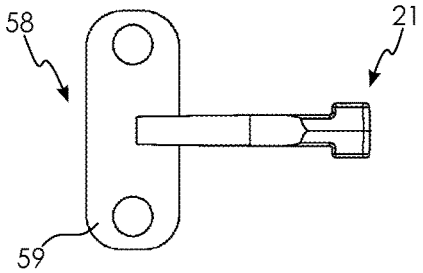

With reference to FIGS. 11 to 13, a second embodiment of the zip fastener 220 of the invention comprises a slider 11 (of like form as in the zip fastener 20 and so it is identified with the same reference number) with one of the male and female parts 21, 22 and wherein, essentially, the other of the male and female parts 21, 22, previously disposed on second slider, is instead formed on a fixture 58 fixed at a longitudinal end of the stringers. The male coupler 21 thus likewise opposes the female coupler 22, so zip fastener 220 can be held closed in manner corresponding to that of zip fastener 20. The fixture 58 may include a flange 59 transverse to the male coupling part 21, with holes 62 for receiving a fastener for mounting the fixture 58. A hole 56 adapted to receive a shackle may also be formed on the fixture 58.

Figure 14:
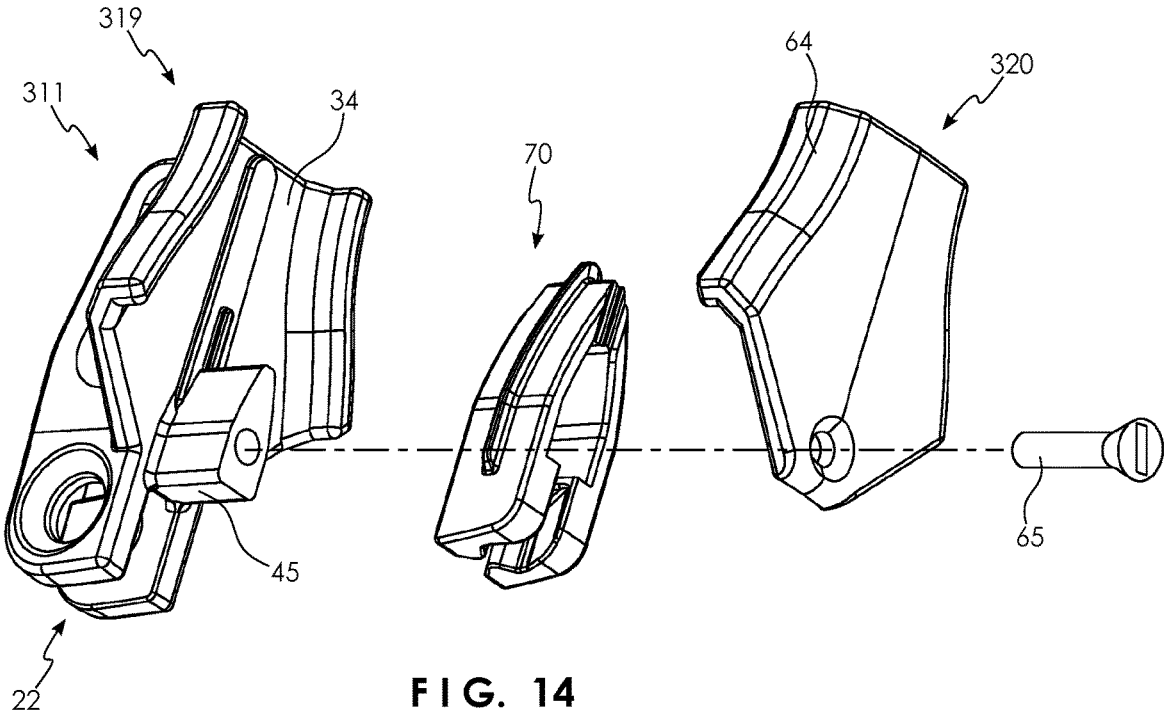
FIG. 14 is a exploded view of a slider according to a third embodiment of the invention.

FIG. 14 illustrates a third embodiment of the zip fastener 320 of the invention, which differs from the previously described embodiments in respect of the slider 311 on which the female part 22 is disposed, the body 319 of which may be an assembly of inner and outer sections 64, 34 each including a respective one of the inner and outer walls 30, 31. The inner and outer sections 64, 34 may each be one-part components and the web 45 may be integral with the outer section 34. Dividing the slider in this manner either side of the longitudinal-transverse plane 27, or parallel thereto, allows for servicing of the zip fastener while it is assembled on a bag. A screw 65 received in a transverse opening in the web 45 may connect the inner and outer sections 64, 34.

Aspects of the present invention have been described by way of example only and it should be appreciated that modifications and additions may be made thereto without departing from the scope thereof.

The invention claimed is:

1. A zip fastener, comprising:

a pair of stringers defining a longitudinal axis;

a slider disposed to slide lengthwise along the pair of stringers and thereby join the pair of stringers together and close an opening between the pair of stringers, wherein the slider includes, at one axial end of the slider, one of a male coupling part and a complementary female coupling part; and a member secured to at least one stringer, of the pair of stringers, wherein the member includes, at one axial end of the member the other of the male coupling part and the complementary female coupling part, the male coupling part comprises an enlarged head and a neck adjacent the enlarged head, the complementary female coupling part comprises a transverse slot with broad and narrow sections sized to slidably receive the head and the neck, such that relative rotation between the slider and the member, and resulting bending of the pair of stringers, allows the head to be inserted transversely into the slot, and bending stiffness of the pair of stringers fends to maintain the head in the slot, and a shoulder between the broad and narrow sections of the complementary female coupling part that abuts the head to prevent axial separation of the slider and the member when the head is in the slot, and the member is either a) a second slider that is disposed to slide lengthwise along the stringers and thereby join the stringers and close the opening between the stringers, or b) a fixture on at least one of the stringers.

2. The zip fastener of claim 1, wherein a plane defined by long axes of the pair of stringers separates inner and outer sides of the zip fastener, the zip fastener further includes a pull-tab attachment post disposed on an outer side of the slider, and the transverse slot has a mouth through which the head transversely passes when the male and the complementary female coupling parts are connected together and disconnected from each other, and the mouth is disposed on an outer side of the respective one of the slider and the member.

3. The zip fastener of claim 2, wherein the one of the male coupling part and the complementary female coupling part is disposed on the outer side of the zip fastener and projects axially from the pull-tab attachment post.

4. The zip fastener of claim 1, further comprising a detent that restricts transverse movement of the male coupling part relative to the complementary female coupling part and provides an audible indication of engagement between the male coupling part and the complementary female coupling parts.

5. The zip fastener of claim 4, wherein the head projects from opposing sides of the neck and the detent comprises a clip of a resilient material with a pair of opposing arms having tips disposed adjacent the complementary female coupling part such that the transverse slot extends between the tips and the tips engage opposing sides of the male coupling part, with each tip and respective opposing side comprising a projection and a complementary recess.

6. The zip fastener of claim 5, wherein the head further comprises opposing ramps that, upon connection of the male coupling part and the complementary female coupling part, spread apart the tips of the arms to engage opposing sides of the male coupling part.

7. The zip fastener of claim 5, wherein the complementary female coupling part further comprises a stop surface extending into the broad section of the slot to abut the head and limit transverse travel of the head in the slot.

8. The zip fastener of claim 5, wherein the slider comprises wedge faces that divide a main channel that receives meshed stringers into two branch channels that receive unmeshed stringers and are disposed on both sides of a central plane, the wedge faces taper to diverge in the longitudinal direction from a narrow end adjacent the main channel to a broad end, and the complementary female coupling part comprises opposing flanges disposed on both sides of the central plane.

9. The zip fastener of claim 8, wherein the wedge faces comprise outer faces of the clip.

10. The zip fastener of claim 5, wherein the slider includes a recess and the clip is held in the recess in the slider by a snap fit.

11. The zip fastener of claim 1, wherein the slider comprises wedge faces that divide a main channel that receives meshed stringers into two branch channels that receive unmeshed stringers and that are disposed on both sides of a central plane, the wedge faces taper to diverge in the longitudinal direction from a narrow end adjacent the main channel to a broad end, the male coupling part comprises a rib that projects from the broad end of the slider, and a proximal end of the rib forms the neck and a distal end of the rib is thickened to form the head.

12. The zip fastener of claim 11, wherein the rib further comprises a circular hole adapted to receive a shackle.

* * * * *